US009283667B2

(12) United States Patent
Zhang et al.

(10) Patent No.: US 9,283,667 B2
(45) Date of Patent: Mar. 15, 2016

(54) POWER TOOL WITH TORQUE CLUTCH

(71) Applicant: Black & Decker Inc., Newark, DE (US)

(72) Inventors: Qiang J. Zhang, Lutherville, MD (US); Rodney D. Milbourne, Abingdon, MD (US); David C. Campbell, Bel Air, MD (US)

(73) Assignee: BLACK & DECKER INC., Newark, DE (US)

( * ) Notice: Subject to any disclaimer, the term of this patent is extended or adjusted under 35 U.S.C. 154(b) by 578 days.

(21) Appl. No.: 13/723,562

(22) Filed: Dec. 21, 2012

(65) Prior Publication Data

US 2013/0175066 A1 Jul. 11, 2013

Related U.S. Application Data

(60) Provisional application No. 61/585,275, filed on Jan. 11, 2012.

(51) Int. Cl.

| | |
|---|---|
| ***B25F 5/00*** | (2006.01) |
| ***B25B 21/00*** | (2006.01) |
| ***B25B 23/147*** | (2006.01) |

(52) U.S. Cl.

CPC ..... *B25F 5/001* (2013.01); *B25B 21/00* (2013.01); *B25B 23/147* (2013.01)

(58) Field of Classification Search

CPC ..... B25F 5/02; B25F 5/001; B25B 23/14; B25B 23/141; B25B 23/147; B25B 21/00

USPC ..... 173/176, 178, 93, 47, 216, 217, 213; 475/265, 286, 298, 299; 192/55.1, 192/56.56

See application file for complete search history.

(56) References Cited

U.S. PATENT DOCUMENTS

| | | | | |
|---|---|---|---|---|
| 6,431,289 | B1 | 8/2002 | Potter et al. | |
| 6,676,557 | B2 * | 1/2004 | Milbourne et al. | 475/286 |
| 6,805,207 | B2 * | 10/2004 | Hagan et al. | 173/170 |
| 6,983,810 | B2 * | 1/2006 | Hara et al. | 173/176 |
| 7,066,691 | B2 | 6/2006 | Doyle et al. | |
| 7,314,097 | B2 * | 1/2008 | Jenner et al. | 173/48 |
| 7,404,781 | B2 | 7/2008 | Milbourne et al. | |
| 7,452,304 | B2 | 11/2008 | Hagan et al. | |
| 7,717,192 | B2 * | 5/2010 | Schroeder et al. | 173/48 |
| 7,882,900 | B2 * | 2/2011 | Borinato et al. | 173/176 |

(Continued)

FOREIGN PATENT DOCUMENTS

WO WO-2012038255 A1 3/2012

*Primary Examiner* — Scott A. Smith
(74) *Attorney, Agent, or Firm* — Stephen R. Valancius

(57) ABSTRACT

A power tool that includes a housing, a motor, a trigger, a multi-speed transmission and a torque clutch. The housing define a handle. The motor is coupled to the housing. The trigger is coupled to the housing and configured to control operation of the motor. The multi-speed transmission is configured to transmit rotary power between the motor and the output spindle and includes a plurality of planetary stages with a first stage and a second stage that receives rotary power from the first stage. The first stage has a first internally toothed gear element and the second stage having a second internally toothed gear element. The torque clutch limits torque output from the multi-speed transmission to the output spindle. The torque clutch is configured to alternatively ground the second and third internally toothed gear elements to the housing based on a speed ratio setting of the multi-speed transmission.

15 Claims, 12 Drawing Sheets

(56) References Cited

U.S. PATENT DOCUMENTS 7,987,922 B2 * 8/2011 Tokunaga ..... 173/178
8,142,326 B2 * 3/2012 Chen ..... 475/299
2005/0061524 A1 3/2005 Hagan et al.
2011/0275471 A1 11/2011 Roehm et al.

* cited by examiner

POWER TOOL WITH TORQUE CLUTCH

CROSS-REFERENCE TO RELATED APPLICATIONS

This application claims the benefit of U.S. Provisional Application No. 61/585,275, filed on Jan. 11, 2012, the entire disclosure of which is incorporated by reference as if fully set forth in detail herein.

FIELD

The present disclosure relates to a power tool with a torque clutch.

BACKGROUND

This section provides background information related to the present disclosure which is not necessarily prior art.

A power tool described in U.S. Pat. No. 6,431,289 employs a three-speed transmission and a torque clutch that is located on a first stage of the three-speed transmission. While such power tool is relatively robust, compact and inexpensive, there nonetheless remains a need in the art for an improved power tool that incorporates an improved multi-speed transmission with a torque clutch that is provided on a stage of the multi-speed transmission other than an input stage.

SUMMARY

This section provides a general summary of the disclosure, and is not a comprehensive disclosure of its full scope or all of its features.

In one form, the present teachings provide a power tool that includes a housing, a motor, a trigger, a multi-speed transmission and a torque clutch. The housing define a handle. The motor is coupled to the housing. The trigger is coupled to the housing and configured to control operation of the motor. The multi-speed transmission is configured to transmit rotary power between the motor and the output spindle and includes a plurality of planetary stages with a first stage and a second stage that receives rotary power from the first stage. The first stage has a first internally toothed gear element and the second stage having a second internally toothed gear element. The torque clutch limits torque output from the multi-speed transmission to the output spindle. The torque clutch is configured to alternatively ground the second and third internally toothed gear elements to the housing through the torque clutch based on a speed ratio setting of the multi-speed transmission.

In another form, the present teachings provide a power tool that includes a housing, a motor, a trigger and a multi-speed transmission. The housing define a handle. The motor is coupled to the housing. The trigger is coupled to the housing and configured to control operation of the motor. The multi-speed transmission has a planetary stage with a ring gear and a plurality of planet gears. The ring gear has an annular inner structure and an annular outer structure. The annular inner structure having a plurality of teeth that are in meshing engagement with the plurality of planet gears. The annular outer structure is axially fixed to but rotatably mounted on the annular inner structure. The ring gear is axially movable between a first position and a second position when the multi-speed transmission is shifted between a first speed ratio and a second speed ratio.

In still another form, the present teachings provide a power tool that includes a housing, a motor coupled to the housing, a trigger, an output spindle and a multi-speed transmission. The trigger is coupled to the housing and configured to control operation of the motor. The multi-speed transmission is configured to transmit rotary power between the motor and the output spindle and has a plurality of planetary stages. A first one of the planetary stages has a planet carrier, while a second one of the planetary stages has a plurality of planet gears and a ring gear that is meshingly engaged with the planet gears. The ring gear of the second one of the planetary stages is movable along a longitudinal axis of the multi-speed transmission between a first position, a second position, and a third position. The ring gear of the second one of the planetary stages is non-rotatably engaged to the housing when the ring gear of the second one of the planetary stages is in the first position. The ring gear of the second one of the planetary stages is disengaged from the housing and non-rotatably engaged to the planet carrier when the ring gear of the second one of the planetary stages is in the third position. The ring gear of the second one of the planetary stages is disengaged from the housing and the planet carrier and engaged to an outer annular structure of a ring gear of another of the planetary stages when the ring gear of the second one of the planetary stages is in the second position.

In yet another form, the present teachings provide a power tool that includes a housing, a motor, a trigger, a multi-speed transmission and a torque clutch. The housing defines a handle. The motor is coupled to the housing. The trigger is coupled to the housing and configured to control operation of the motor. The multi-speed transmission has first and second ring gears. The torque clutch includes a clutch member, a follower, and a clutch spring. The clutch member has first and second sets of clutch teeth and a clutch profile. The first set of clutch teeth is configured to non-rotatably couple the second ring gear to the clutch member. The second set of clutch teeth is configured for use in non-rotatably coupling the first ring gear to the clutch member. The follower is non-rotatably coupled to the housing. The clutch spring biases the follower into engagement with the clutch profile to resist rotation of the clutch member.

In a further form, the present teachings provide a power tool having a housing, a motor, a trigger, a multi-speed transmission, and a speed selector. The motor is coupled to the housing. The trigger is coupled to the housing and configured to control operation of the motor. The multi-speed transmission is configured to transmit rotary power between the motor and the output spindle. The multi-speed transmission includes a plurality of planetary stages arranged about a rotational axis. The plurality of planetary stages includes a first stage and a second stage that receives rotary power from the first stage. The first stage has a first internally toothed gear element, while the second stage has a second internally toothed gear element. The speed selector has a coupler that is non-rotatably but slidably coupled to the housing for movement along the rotational axis between a first position, a second position and a third position. The second internally toothed gear element is axially fixed but rotatable relative to the coupler. Positioning of the coupler in the first position non-rotatably couples the first and second internally toothed gear elements to the housing, wherein positioning the coupler in the second position non-rotatably couples the first internally toothed gear element to the housing and positions the second internally toothed gear element such that it is rotatable relative to the housing, and wherein positioning the coupler in the third position decouples the coupler from the first internally toothed gear element and positions the second internally toothed gear element such that it is non-rotatably coupled to the housing.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings. Although the terms first, second, third, etc. may be used herein to describe various elements, components, assemblies and/or groups, these elements, components, assemblies and/or groups should not be limited by these terms. These terms may be only used to distinguish one element, component, assembly and/or group from another element, components, assembly and/or group. Terms such as "first," "second," and other numerical terms when used herein do not imply a sequence or order unless clearly indicated by the context. Thus, a first element, component, assembly or group discussed below could be termed a second element, component, assembly or group without departing from the teachings of the example embodiments.

Figure 1:
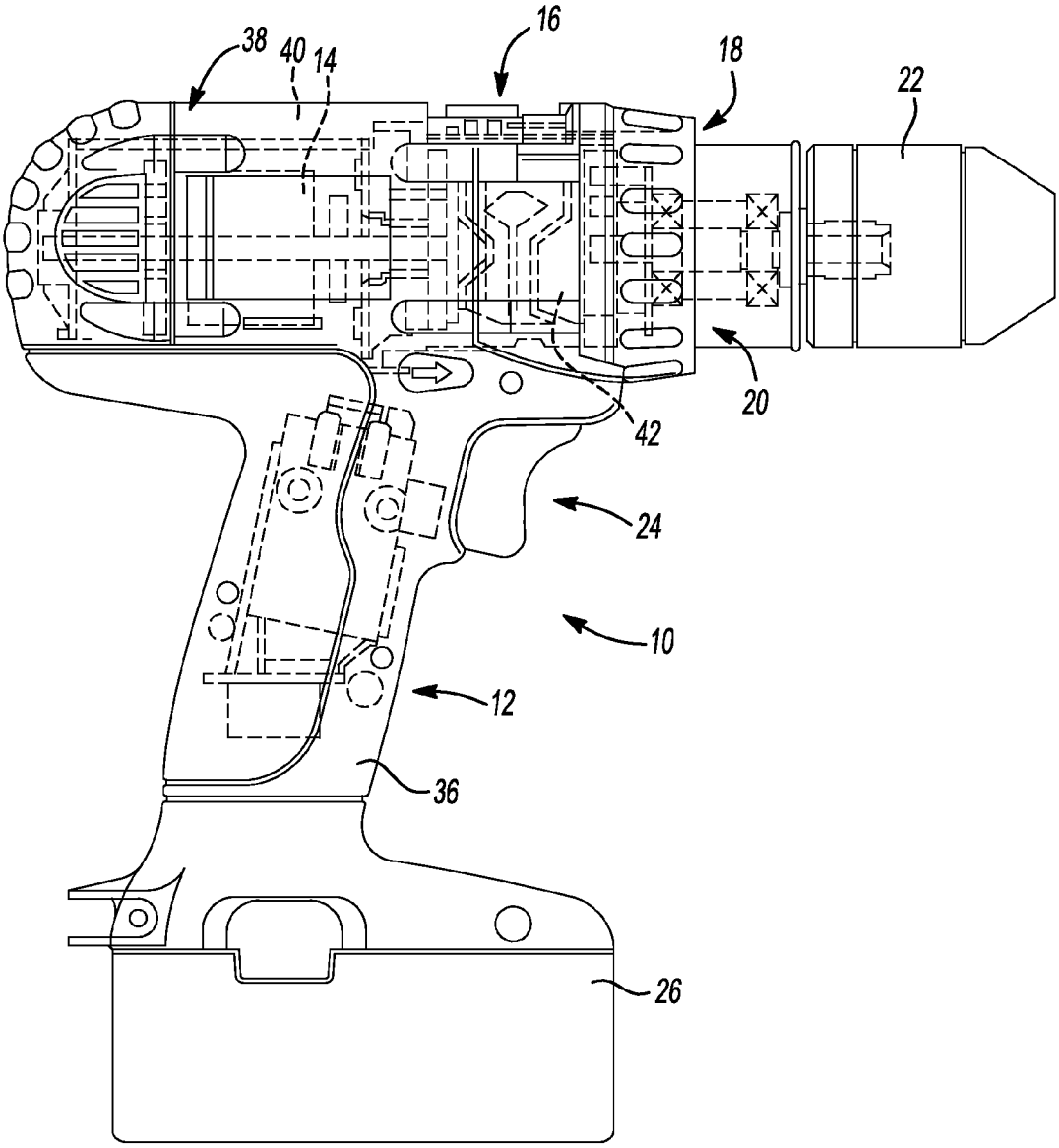
FIG. 1 is a side elevation view of an exemplary power tool constructed in accordance with the teachings of the present disclosure.
Figure 2:
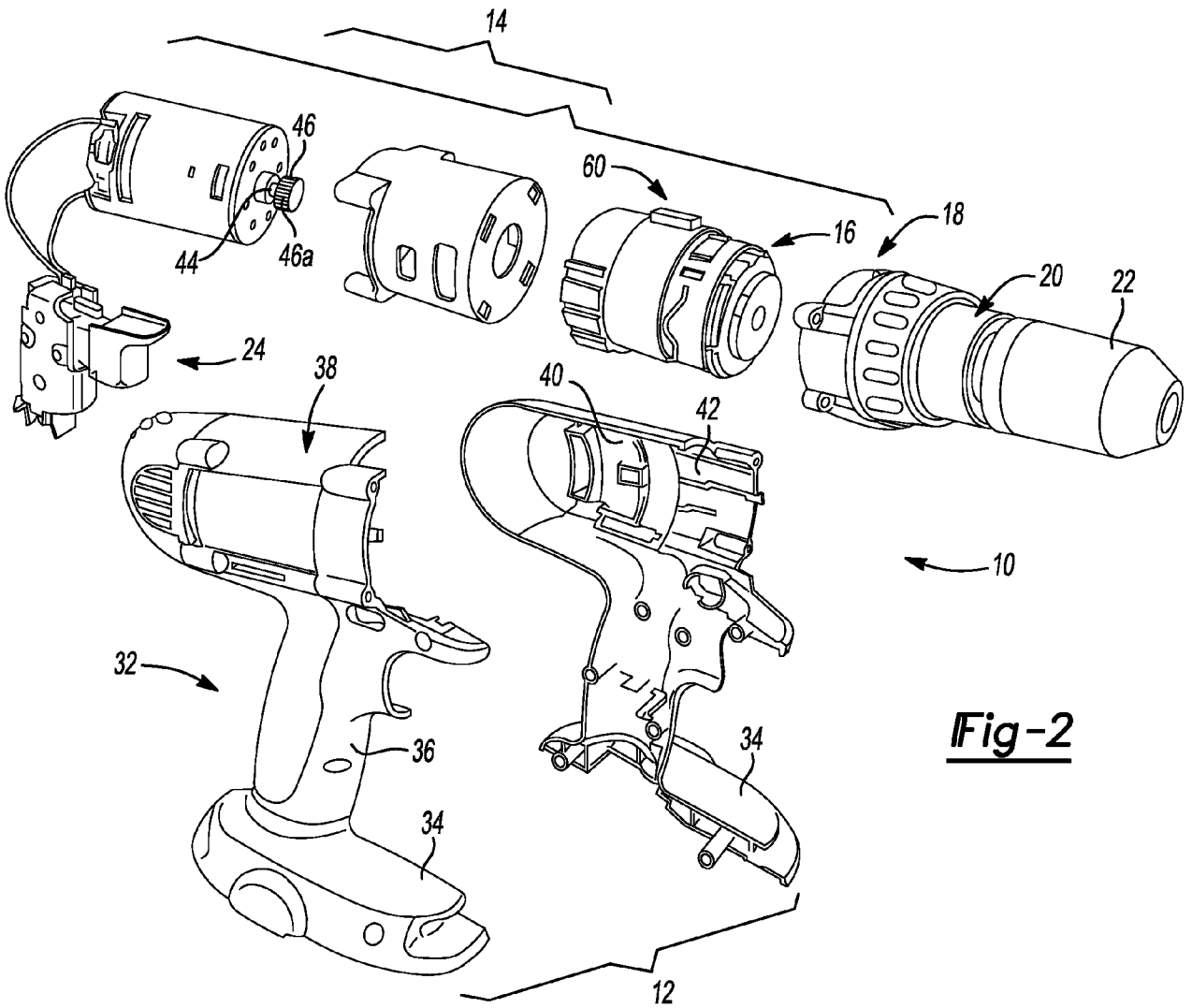
FIG. 2 is an exploded perspective view of a portion of the power tool of FIG. 1.

With reference to FIGS. 1 and 2 of the drawings, a power tool constructed in accordance with the teachings of the present disclosure is generally indicated by reference numeral 10. As those skilled in the art will appreciate, the preferred embodiment of the present disclosure may be either a corded or cordless (battery operated) device, such as a portable screwdriver or drill (e.g., drill, hammer drill). In the particular embodiment illustrated, power tool 10 may be a cordless drill having a housing 12, a motor assembly 14, a multi-speed transmission assembly 16, a clutch assembly 18, an output spindle assembly 20, a chuck 22, a trigger assembly 24 and a battery pack 26. Those skilled in the art will understand that several of the components of power tool 10, such as the chuck 22, the trigger assembly 24 and the battery pack 26, can be conventional in nature and need not be described in significant detail in this application. Reference may be made to a variety of publications for a more complete understanding of the operation of the conventional features of power tool 10. One example of such publications is commonly assigned U.S. Pat. No. 7,452,304 issued Nov. 18, 2008, the disclosure of which is hereby incorporated by reference as if fully set forth herein.

The housing 12 can include a handle shell assembly 32 that can include a pair of mating handle shells 34. The handle shell assembly 32 can define a handle portion 36 and a drive train or body portion 38. The trigger assembly 24 and the battery pack 26 can be mechanically coupled to handle portion 36 and can be electrically coupled to motor assembly 14 such that the trigger assembly 24 is configured to control the operation of the motor assembly 14. The body portion 38 can include a motor cavity 40 and a transmission cavity 42. The motor assembly 14 can be housed in motor cavity 40 and can include a rotatable output shaft 44 that can extend into transmission cavity 42. A motor pinion 46 having a plurality of gear teeth 46*a* can be coupled for rotation with output shaft 44. The trigger assembly 24 and the battery pack 26 can cooperate to selectively provide electric power to the motor assembly 14 in a manner that is generally well known in the art so as to control the speed and direction with which the output shaft 44 rotates.

The transmission assembly 16 can be housed in the transmission cavity 42 of the housing 12 and can include a speed selector mechanism 60. Rotary power output from the motor assembly 14 can be transmitted through the transmission assembly 16 to the output spindle assembly 20 as will be discussed in more detail below. The transmission assembly 16 can include a plurality of elements that can be selectively moved by the speed selector mechanism 60 to cause the transmission assembly 16 to operate in a plurality of speed ratios. Each of the speed ratios can multiply the speed and torque of the drive input in a predetermined manner, permitting the output speed and torque of the transmission assembly 16 to be varied in a desired manner between a relatively low speed, high torque output and a relatively high speed, low torque output. The clutch assembly 18 can be coupled to the transmission assembly 16 and can be operable for limiting an output torque of the transmission assembly 16 (which is input to the output spindle assembly 20) in a predetermined but user-selectable manner.

Figure 3:
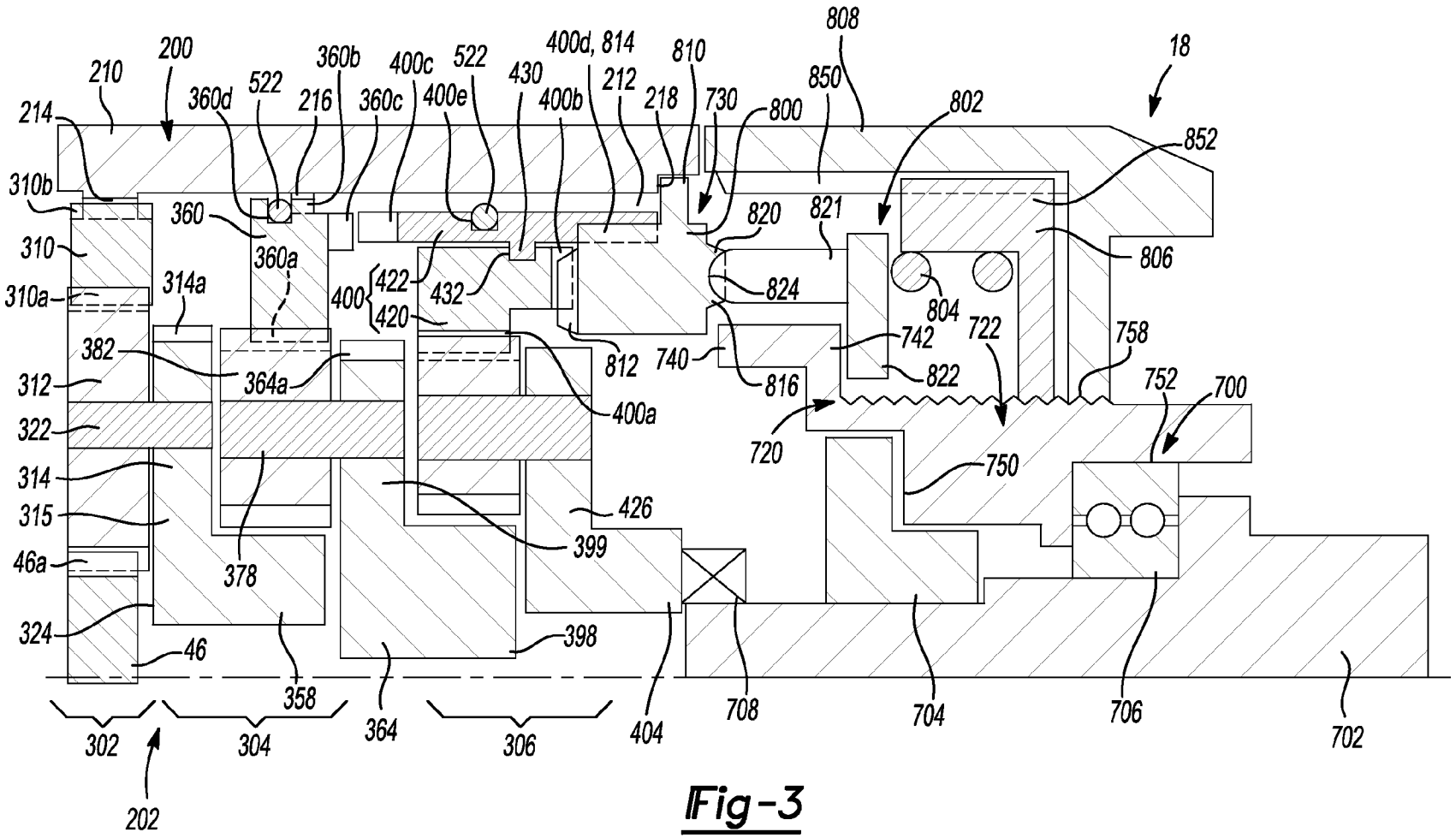
FIG. 3 is a longitudinal section view of a portion of the power tool of FIG. 1 illustrating the transmission assembly and the clutch mechanism in more detail, the transmission assembly being shown in a low speed setting.

With reference to FIGS. 2 and 3, the transmission assembly 16 can be a three-stage, three-speed transmission that can include a transmission sleeve 200, a reduction gear set assembly 202 and the speed selector mechanism 60. The transmission sleeve 200 can be received in the transmission cavity 42 in the handle shell assembly 32 and can be interlocked to the handle shell assembly 32 so as to be axially and non-rotatably fixed thereto. The transmission sleeve 200 can be coupled to the motor assembly 14 (e.g., via the housing assembly 12) and can include a wall member 210 that can define a transmission bore or hollow cavity 212 into which the reduction gear set assembly 202 can be received. The wall member 210 can further define a first set of locking features 214, a second set of locking features 216, and a shoulder wall 218. In the particular example provided, the first and second sets of locking features 214 and 216 comprise teeth that extend radially inwardly from the wall member 210, but it will be appreciated that the first set of locking features 214 and/or the second set of locking features 216 could be configured differently and need not comprise teeth per se.

Figure 4:
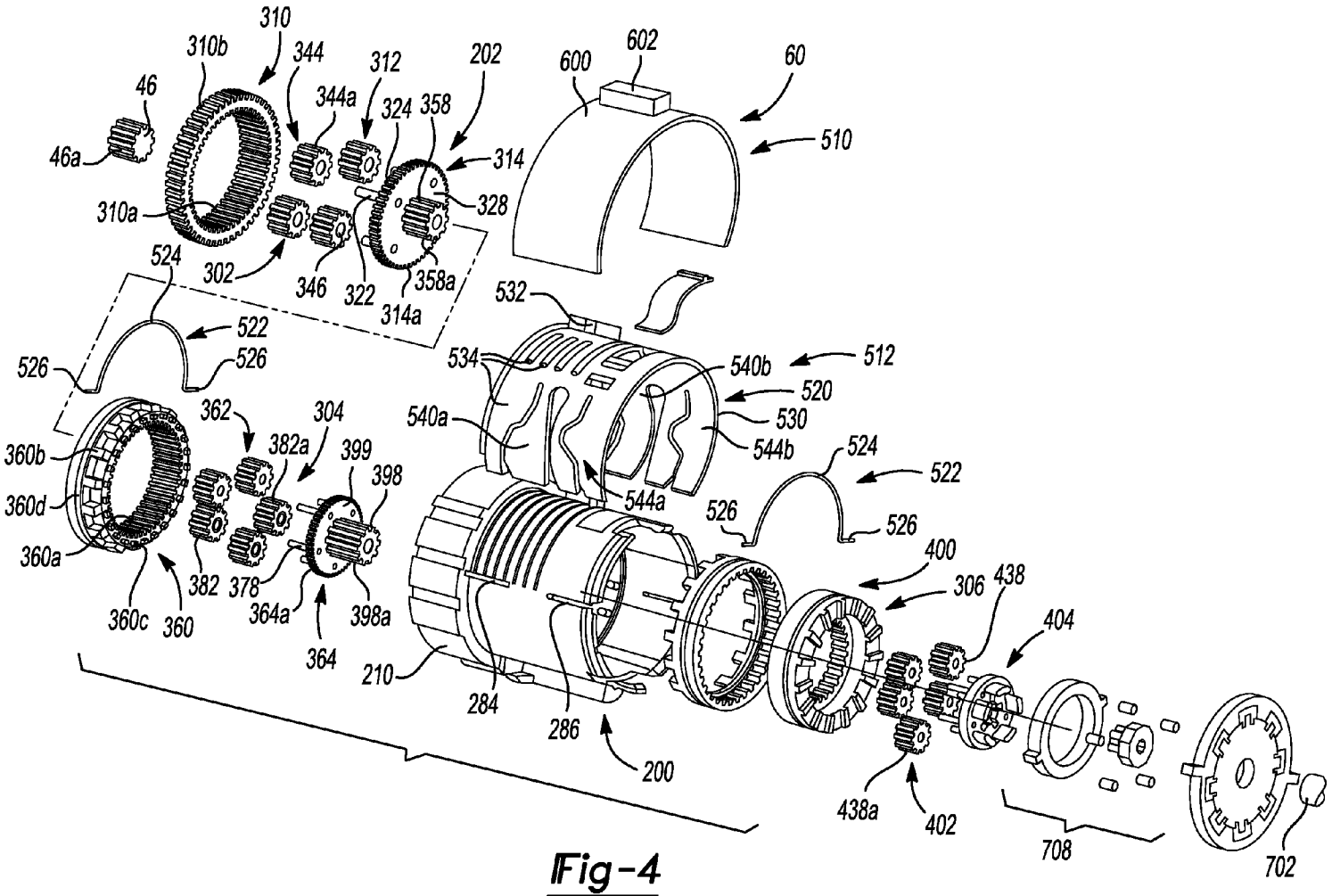
FIG. 4 is an exploded perspective view of a portion of the power tool of FIG. 1 illustrating the transmission assembly in more detail.

With reference to FIGS. 3 and 4, a pair of first clip slots 284 and a pair of second clip slots 286 can be formed into the transmission sleeve 200, extending through the wall member 210 and along the sides of the transmission sleeve 200 in a manner that can be parallel the longitudinal axis of the transmission sleeve 200. The first pair of clip slots 284 may be formed through the sides of the body portion 246 rearwardly of the second set of locking features 216. The second pair of clip slots 286 can be also formed through the sides of the body portion 246, but can be positioned forwardly of the second set of locking features 216 and rearwardly of the shoulder wall 218.

The reduction gear set assembly 202 can include a first stage or reduction gear set 302, a second stage or reduction gear set 304 and a third stage or reduction gear set 306. In the particular embodiment illustrated, each of the first, second and third reduction gear sets 302, 304 and 306 is a planetary gear set. Those skilled in the art will understand, however, that various other types of reduction gear sets that can be well known in the art may be substituted for one or more of the reduction gear sets forming the reduction gear set assembly 202.

The first reduction gear set 302 can include a first ring gear 310, a first set of planet gears 312 and a first planet or reduction carrier 314. The first ring gear 310 can have a plurality of gear teeth 310*a*, which can be formed along its interior diameter, and a first set of mating locking features 310*b* that can be formed about its exterior circumference. The first ring gear 310 can be disposed within the hollow cavity 212 of the transmission sleeve 200 such that the first set of mating locking features 310*b* matingly engage the first set of locking features 214 on the transmission sleeve 200 to thereby non-rotatably couple the first ring gear 310 to the transmission sleeve 200. The first reduction carrier 314 can have a body 315, which can be is formed in the shape of a flat cylinder, and a plurality of pins 322 that can be coupled to the body 315 and extend from its rearward face 324. A plurality of gear teeth 314*a* can be formed into almost the entire outer perimeter of the first reduction carrier 314. In the particular embodiment illustrated, the gear teeth 314*a* of the first reduction carrier 314 can be configured so as not to be meshingly engagable with the gear teeth 310*a* of the first ring gear 310.

The first set of planet gears 312 may include a plurality of planet gears 344, each of which having a plurality of gear teeth 344*a* formed into its outer perimeter and a pin aperture 346 formed through its center. Each planet gear 344 may be rotatably supported on an associated one of the pins 322 of the first reduction carrier 314 and is positioned such that its teeth 344*a* meshingly engage the teeth 310*a* of the first ring gear 310 as well as the teeth 46*a* of the motor pinion 46. Accordingly, it will be appreciated that the motor pinion 46 is the sun gear of the first reduction gear set 302.

The second reduction gear set 304 may be disposed within the portion of the hollow cavity 212 and can include a second sun gear 358, a second ring gear 360, a second set of planet gears 362 and a second planet or reduction carrier 364. The second sun gear 358 may be fixed for rotation with the first reduction carrier 314 and as such, those of skill in the art will appreciate from this disclosure that the first reduction carrier 314 can be an output member of the first reduction gear set 302, that the second sun gear 358 can be an input member of the second reduction gear set 304, and that the output member of the first reduction gear set 302 outputs rotary power to the input member of the second reduction gear set 304. The second sun gear 358 can include a plurality of gear teeth 358*a* that can extend forwardly of the forward face 328 of the first reduction carrier 314.

The second ring gear 360 can be an annular structure, having a plurality of gear teeth 360*a*, which can be formed about its interior circumferential surface, a plurality of second mating locking features 360*b*, which can be formed about its exterior circumferential surface, a plurality of first clutch teeth 360*c*, which can be formed on an end surface of the second ring gear 360, such as a forward end surface, and a first actuator groove 360*d* that can be formed about the exterior circumference of the second ring gear 360. The second reduction carrier 364 can comprise a body 399 and a plurality of pins 378. The body 399 can be formed in the shape of a flat cylinder and a plurality of gear teeth 364*a* can be formed about the perimeter of the body 399. The pins 378 can extend from a rearward face of the body 399. The second set of planet gears 362 may include a plurality of planet gears 382, each of which being rotatably mounted on an associated one of the pins 378 and having gear teeth 382*a* that are meshingly engaged with the gear teeth 360*a* on the second ring gear 360 and the gear teeth 358*a* of the second sun gear 358.

Figure 6:
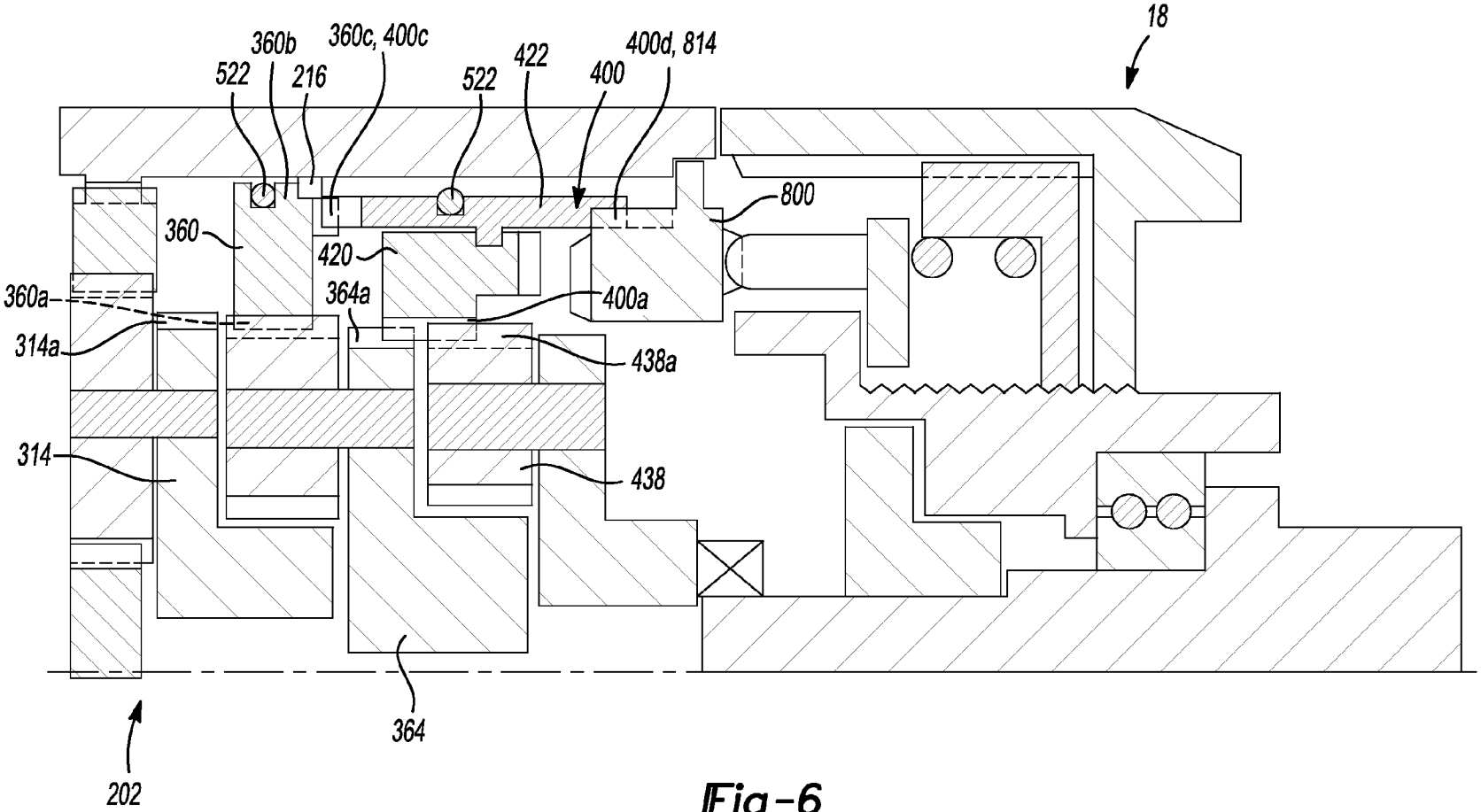
FIGS. 6 and 7 are longitudinal section views similar to that of FIG. 3 except showing the transmission assembly in the intermediate and high speed settings, respectively.
Figure 7:
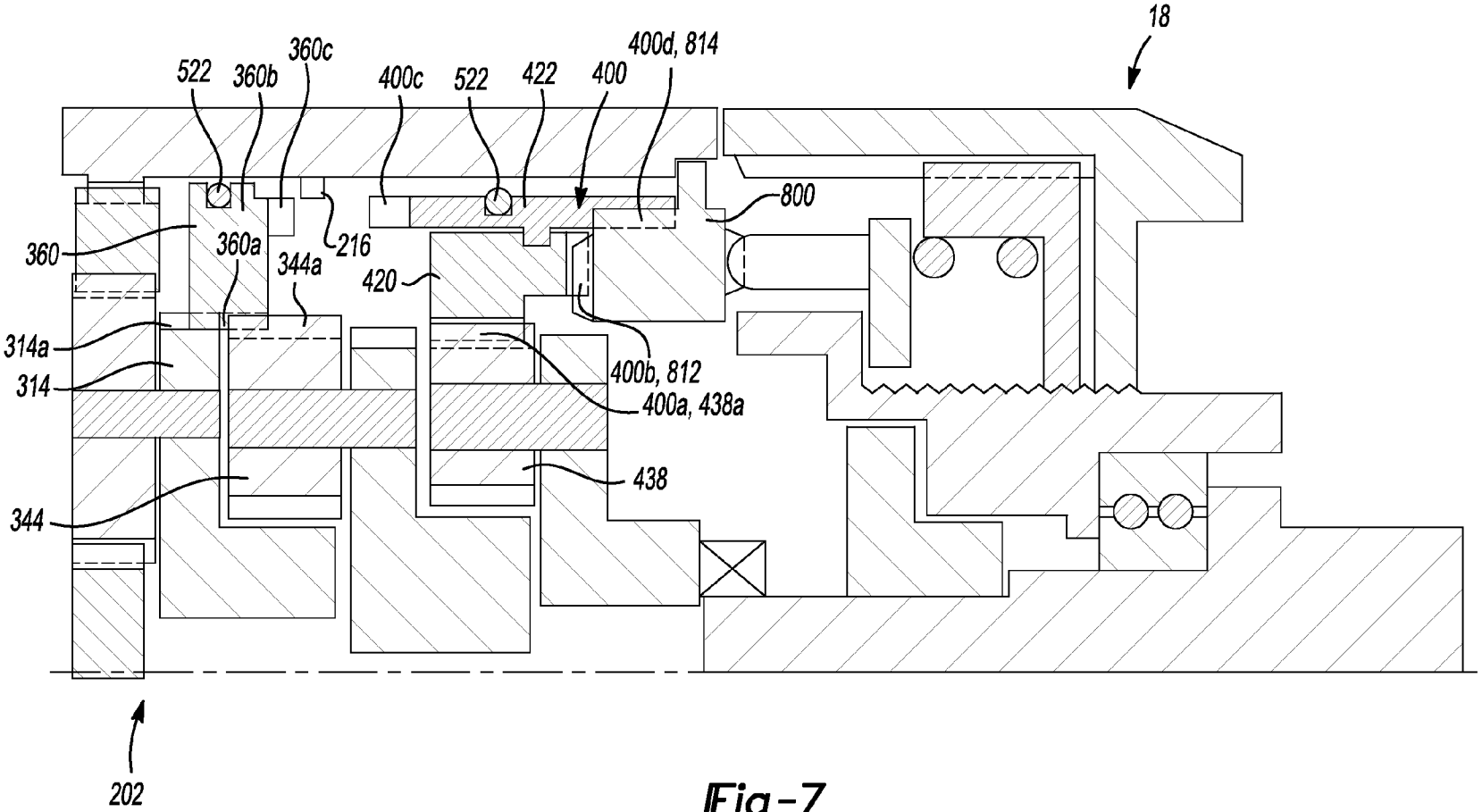

The second ring gear 360 can be axially slidably disposed within the hollow cavity 212 of the transmission sleeve 200 such that the second ring gear 360 can be moved between a first position (FIG. 3), a second position (FIG. 6), and a third position (FIG. 7). When positioned in the first position, the gear teeth 360*a* can be axially offset from the gear teeth 314*a* of the first reduction carrier 314 and the second set of mating locking features 360*b* can be matingly engaged to the second set of locking features 216 on the transmission sleeve 200 to thereby non-rotatably couple the second ring gear 360 to the transmission sleeve 200. When positioned in the second position, the gear teeth 360*a* can be axially offset from the gear teeth 314*a* of the first reduction carrier 314 and the second set of mating locking features 360*b* can be axially offset from the second set of locking features 216. When positioned in the third position, the gear teeth 360*a* can be engaged to the gear teeth 314*a* of the first reduction carrier 314 and the second set of mating locking features 360*b* can be axially offset from the second set of locking features 216.

The third reduction gear set 306 can be disposed within the hollow cavity 212 in the transmission sleeve 200 and can include a third sun gear 398, a third ring gear 400, a third set of planet gears 402 and a third planet or reduction carrier 404. The third sun gear 398 can be fixed for rotation with the second reduction carrier 364 and can include a plurality of gear teeth 398*a* that can extend forwardly of the front face 406 of the second reduction carrier 364. Accordingly, those of skill in the art will appreciate that the second reduction carrier 364 can be an output member of the second reduction gear set 304, that the third sun gear 398 can be an input member of the third reduction gear set 306 and that the output member of the second reduction gear set 304 can output rotary power to the input member of the third reduction gear set 306.

The third ring gear 400 can comprise an inner annular structure 420 and an outer annular structure 422. The inner annular structure 420 can define a plurality of gear teeth 400*a*, which can be formed about an inside circumferential surface, and a set of second clutch teeth 400*b* that can be formed on an axial end (e.g., a front axial end) of the inner annular structure 420. The outer annular structure 422 can define a plurality of third clutch teeth 400*c*, a plurality of fourth clutch teeth 400*d*, and a second actuator groove 400*e* that can be formed about the exterior circumference of the outer annular structure 422. The inner and outer annular structures 420 and 422 can be coupled to one another in any desired manner such that they are axially fixed but rotatable relative to one another. For example, one of the inner and outer annular structures 420 and 422 (e.g., the outer annular structure 422 in the example provided) can comprise a circumferentially extending rib 430 that can be received into a circumferentially extending groove 432 formed in the other one of the inner and outer annular structures 420 and 422 (e.g., the inner annular structure 420 in the example provided). The rib 430 and the groove 432 can be sized to permit relative rotation between the inner and outer annular structures 420 and 422, but inhibit relative axial movement there between. While both the inner and outer annular structures 420 and 422 have been illustrated as being unitarily formed, it will be appreciated that one or both of the inner and outer annular structures 420 and 422 could be formed of two or more components to improve the assembleability of the inner and outer annular structures 420 and 422. For example, the inner annular structure 420 could be formed of a body (not shown) and a retaining ring (not shown). The body could define all of the inner annular structure 420 except for an (open) axial end of the groove 432. The retaining ring could be a conventional external snap ring that could be engaged to the body to close the open axial end of the groove 432. Construction in this manner permits the outer annular structure 422 to be slipped onto the body and thereafter the retaining ring could be fitted to the body to complete the assembly.

The third reduction carrier 404 can comprise a body 426 and a plurality of pins 428. The body 426 can be formed in the shape of a flat cylinder and the pins 428 can extend from a rearward face of the body 426. The third set of planet gears 402 can include a plurality of third planet gears 438, each of which being rotatably mounted on an associated one of the pins 428 and having gear teeth 438*a* that are meshingly engaged to the teeth 400*a* of the third ring gear 400 and the teeth 398*a* of the third sun gear 398.

The third ring gear 400 can be axially slidably disposed within the hollow cavity 212 of the transmission sleeve 200 such that the third ring gear 400 can be moved between a first position and a second position. When positioned in the first position, the gear teeth 400*a* can be meshingly engaged with (only) the teeth 438*a* of the third planet gears 438. When positioned in the second position, the gear teeth 400*a* can be meshingly engaged with both the teeth 438*a* of the third planet gears 438 and the teeth 364*a* of the second reduction carrier 364.

The speed selector mechanism 60 can include a switch portion 510, which can be configured for receiving a speed change input, and an actuator portion 512 that can interact directly with the reduction gear set assembly 202 in accordance with the speed change input. The actuator potion 512 can include a rotary selector cam 520, and a pair of wire clips 522.

Each of the wire clips 522 can be formed from a round wire which can be formed or bent in the shape of a semi-circle 524 with a pair of tabs 526. The tabs 526 can extend outwardly from the semi-circle 524 and can be positioned on or proximate the centerline of the semi-circle 524. The semi-circle 524 can be sized to fit within the actuator grooves 360*d* and 400*e* in the second and third ring gears 360 and 400, respectively. In this regard, the semi-circle 524 neither extends radially outwardly of an associated one of the ring gears (360, 400), nor binds against the sidewalls of the actuator grooves (360*d*, 400*e*). In the example provided, the sidewalls of the actuator grooves (360*d*, 400*e*) are spaced apart about 0.05 inch and the diameter of the wire forming the wire clips 522 is about 0.04 inch. The tabs 526 of the wire clips 522 can extend outwardly of the hollow cavity 212 and through an associated one of the clip slots (284, 286) that may be formed into the transmission sleeve 200. The tabs 526 can be long enough so that they extend outwardly of the outer surface of the transmission sleeve 200.

The rotary selector cam 520 may include an arcuate selector body 530, a switch tab 532 and a plurality of spacing members 534. A pair of first cam slots 540*a* and 540*b*, and a pair of second cam slots 544*a* and 544*b* can be formed through the selector body 530. The selector body 530 may be sized to engage the outside diameter of the transmission sleeve 200 in a slip-fit manner to permit the rotary selector cam 520 to be rotatably mounted on the transmission sleeve 200.

Figure 5:
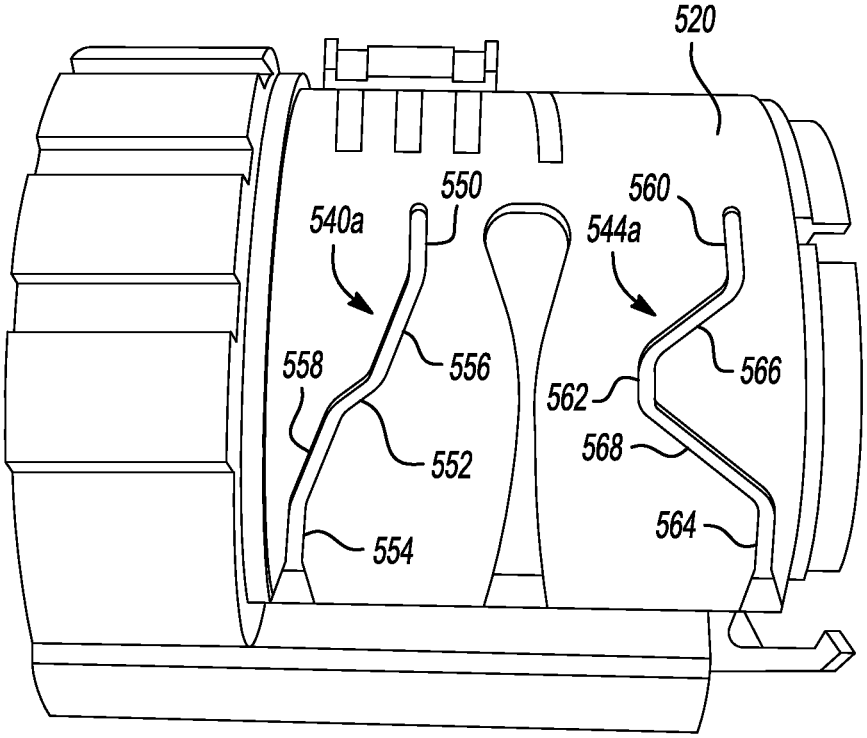
FIG. 5 is a side elevation view of a portion of the power tool of FIG. 1 illustrating a portion of a speed selector mechanism in more detail.

With reference to FIGS. 4 and 5, each of the first cam slots 540*a* and 540*b* may be sized to receive one of the tabs 526 of the wire clip 522 that is engaged to the second ring gear 360. In the particular embodiment illustrated, first cam slot 540*a* can include a first segment 550, a second segment 552, a third segment 554, and a first intermediate segment 556 and a second intermediate segment 558. The first segment 550 can be located a first predetermined distance away from a reference plane (not shown) that is oriented perpendicular to the longitudinal/rotational axis of the rotary selector cam 520. The second segment 552 can be located a second distance away from the reference plane. The third segment 554 can be located a third distance away from the reference plane such that the second segment 552 is disposed between the first and third segments 550 and 554. The first intermediate segment 556 can couple the first and second segments 550 and 552 to one another. The second intermediate segment 558 can couple the second and third segments 552 and 554 to one another. The configuration of first cam slot 540*b* is identical to that of first cam slot 540*a*, except that each of the first, second and third segments 550, 552 and 554 and the first and second intermediate segments 556 and 558 in the first cam slot 540*b* can be located 180° apart from the first, second and third segments 550, 552 and 554 and the first and second intermediate segments 556 and 558, respectively, in the first cam slot 540*a*.

Each of the second cam slots 544*a* and 544*b* may be sized to receive one of the tabs 526 of the wire clip 522 that is engaged to the third ring gear 400. In the particular embodiment illustrated, second cam slot 544*a* can include a first segment 560, a second segment 562, a third segment 564, a first intermediate segment 566 and a second intermediate segment 568. The first and third segments 560 and 564 can be located a fourth predetermined distance away from the reference plane and the second segment 562 may be located a fifth distance away from the reference plane. The first intermediate segment 566 can couple the first and second segments 560 and 562 to one another and the second intermediate segment 568 can couple the second and third segments 562 and 564 together. The configuration of second cam slot 544*b* is identical to that of second cam slot 544*a*, except that it is rotated relative to the rotary selector cam 520 such that each of the first, second, third and intermediate segments 560, 562, 564 and 566 and 568 in the second cam slot 544*b* can be located 180° apart from the first, second, third and intermediate segments 560, 562, 564 and 566 and 568, respectively, in the second cam slot 544*a*.

With the tabs 526 of the wire clips 522 engaged to the first cam slots 540*a* and 540*b* and the second cam slots 544*a* and 544*b*, the rotary selector cam 520 may be rotated on the transmission sleeve 200 between the first, second and third positions to selectively move the second and third ring gears 360 and 400. During the rotation of the rotary selector cam 520, the first cam slots 540*a* and 540*b* and the second cam slots 544*a* and 544*b* confine the wire tabs 526 of their associated wire clip 522 and cause the wire tabs 526 to travel along the longitudinal axis of the transmission sleeve 200 in an associated one of the first and second clip slots 284 and 286. Accordingly, the rotary selector cam 520 may be operative for converting a rotational input to an axial output that causes the wire clips 522 to move axially in a predetermined manner.

Returning to FIG. 4, the switch portion 510 may include an arcuate band 600 having a raised hollow and rectangular selector button 602 formed therein. The arcuate band 600 may be formed from a plastic material and may be configured to conform to the outer diameter of the rotary selector cam 520. The open end of the selector button 602 may be configured to receive the switch tab 532, thereby permitting the switch portion 510 and the rotary selector cam 520 to be coupled to one another in a fastener-less manner. The plurality of spacing members 534 can be raised portions formed into the rotary selector cam 520 that can be concentric to and extend radially outwardly from the selector body 530. The spacing members 534 elevate the arcuate band 600 to prevent the arcuate band from contacting the wire tabs 526 in the first cam slots 540*a* and 540*b*. The spacing members 534 may also be employed to selectively strengthen areas of the rotary selector cam 520, such as in the areas adjacent the first cam slots 540*a* and 540*b*.

Those skilled in the art will understand from this disclosure that the rotary selector cam 520 (i.e., the first cam slots 540*a* and 540*b* and the second cam slots 544*a* and 544*b*) could be configured somewhat differently so as to cause the second ring gear 360 to meshingly engage both the second planet gears 362 and the first reduction carrier 314 while the third ring gear 400 meshingly engages both the third planet gears 402 and the second reduction carrier 364. Configuration in this manner would provide the transmission assembly 16 with a fourth overall gear reduction or speed ratio.

Those skilled in the art will also understand that selector mechanisms of other configurations may be substituted for the speed selector mechanism 60 illustrated herein. These selector mechanisms may include actuators that can be actuated via rotary or sliding motion and may include linkages, cams or other devices that are well known in the art to slide the second and third ring gears 360 and 400 relative to the transmission sleeve 200. Such mechanisms may include one or more springs to provide compliance in the selector mechanism to permit a user to complete movement of an input switch (e.g., the switch portion) despite misalignment between the teeth of various components of the reduction gear set assembly 202. Those skilled in the art will also understand that as the second and third ring gears 360 and 400 can be independently movable between their various positions so that the placement of one of the second and third ring gears 360 and 400 will not dictate the positioning of the other one of the second and third ring gears 360 and 400.

Returning to FIGS. 2 and 3, the output spindle assembly 20 can comprise a spindle housing 700, an output spindle 702, one or more spindle bearings (e.g., first and second spindle bearings 704 and 706, respectively), and a spindle lock mechanism 708. The spindle housing 700 can be fixedly and non-rotatably coupled to the housing 12 and can define a radial flange portion 720 and a collar portion 722. The radial flange portion 720 can be disposed proximate the shoulder wall 218 on the transmission sleeve 200 such that the spindle housing 700 and the transmission sleeve 200 cooperate to form an annular opening 730 there between. The radial flange portion 720 can comprise a circumferentially extending wall portion 740 and a radially extending wall portion 742 that can couple the circumferentially extending wall portion 740 to the collar portion 722. The collar portion 722 can extend axially forwardly of the radial flange portion 720 and can define first and second bearing mounts 750 and 752, respectively, which can be configured to receive the first and second spindle bearings 704 and 706, respectively, and a helical thread form 758 that can be disposed on an exterior surface of the collar portion 722. The output spindle 702 can be a shaft-like structure that can be supported for rotation relative to the spindle housing 700 by the first and second spindle bearings 704 and 706. As those of skill in the art will appreciate, the output spindle 702 can be employed to directly drive a tool bit (not shown) or tool bit holder (not shown). The spindle lock mechanism 708 is conventional in its construction and operation and as such, need not be described in detail herein. Briefly, the spindle lock mechanism 708 is configured to transmit rotary power from an output of the reduction gear set assembly 202 (i.e., the third reduction carrier 404) to the output spindle 702, but to inhibit transmission of rotary power from the output spindle 702 to the output of the reduction gear set assembly 202. It will be appreciated that the spindle lock mechanism 708 inhibits rotation of the output spindle 702 in response to a user's application of external rotary power to the output spindle 702, which may be beneficial where the power tool includes a keyless chuck. Those of skill in the art will appreciate, however, that the spindle lock mechanism 708 is optional and may be omitted in its entirety (in which case the output spindle 702 could be directly coupled to the output of the reduction gear set assembly 202 for rotation therewith).

The clutch assembly 18 can comprise a clutch member 800, a follower 802, a clutch spring 804, a clutch spring adjuster 806, and a clutch collar 808. The clutch member 800 can be an annular structure that can be received into the transmission sleeve 200. The clutch member 800 can define a shoulder 810, a set of fifth clutch teeth 812, a set of sixth clutch teeth 814 and a clutch face 816. The shoulder 810 can project radially outward and can abut the shoulder wall 218 on the transmission sleeve 200 to thereby limit axial movement of the clutch member 800 in a direction toward the motor assembly 14 (FIG. 1). The set of fifth clutch teeth 812 can be configured to meshingly engage the set of second clutch teeth 400*b* formed on the inner annular structure 420 of the third ring gear 400. The set of sixth clutch teeth 814 can be configured to meshingly engage the set of fourth clutch teeth 400*d* formed on the outer annular structure 422 of the third ring gear 400. The clutch face 816 can define a clutch profile 820 that can extend or be accessible through the annular opening 730 so that it may be engaged by the follower 802.

The follower 802 can be configured to transmit force between the clutch spring 804 and the clutch profile 820. In the particular example provided, the follower 802 comprises a plurality of legs 821 and a reaction plate 822. The legs 821 can be generally cylindrical structures having a spherical end face 824 that can be abutted against the clutch profile 820. The reaction plate 822 can be a flat, annular (i.e., washer-like) structure that can be mounted over the collar portion 722 and non-rotatably coupled to the spindle housing 700. The reaction plate 822 can be fixedly coupled to the legs 821 on a side opposite the spherical end faces 824. Alternatively, the reaction plate 822 and legs 821 can be discrete components provided that another structure, such as the spindle housing 700, is configured to inhibit rotation of the legs 821 about the rotary axis of the output spindle 702. The clutch spring 804 can be a helical coil (compression) spring that can be received over the collar portion 722. The clutch spring adjuster 806 can be received on the collar portion 722 and can be threadably engaged to the helical thread form 758 on the spindle housing 700. It will be appreciated that the clutch spring adjuster 806 can be rotated to change its axial position on the collar portion 722 to thereby change the magnitude of the displacement of the clutch spring 804 (i.e., the amount by which it is compressed from its equilibrium length). The clutch collar 808 can be rotatably disposed on the collar portion 722 and a retaining ring (not shown) can be employed to maintain the clutch collar 808 in a desired axial position relative to the spindle housing 700. The clutch collar 808 can have longitudinally extending spline teeth 850 that can meshingly engage corresponding spline teeth 852 formed on the clutch spring adjuster 806. Engagement of the spline teeth 850 and 852 to one another couples the clutch spring adjuster 806 to the clutch collar 808 for rotation therewith but permits the clutch spring adjuster 806 to travel axially along the collar portion 722 of the spindle housing 700 while the clutch collar 808 is maintained in a fixed axial position.

In operation, the clutch assembly 18 is employed to inhibit rotation of at least one of the second and third ring gears 360 and 400 unless a reaction force applied to the clutch member 800 exceeds a clutch torque (that is dictated by the displacement of the clutch spring 804).

With reference to FIGS. 3 through 5, positioning the rotary selector cam 520 in the first rotational position positions the tabs 526 of the wire clip 522 that is engaged to the second ring gear 360 in the first segment 550 of the first cam slots 540*a* and 540*b* so that the second ring gear 360 is positioned in its first position (i.e., such that the second set of mating locking features 360*b* are matingly engaged to the second set of locking features 216 to thereby non-rotatably couple or "ground" the second ring gear 360 to the transmission sleeve 200 and the housing assembly 12 (FIG. 1)). Positioning the rotary selector cam 520 in the first rotational position also positions the tabs 526 of the wire clip 522 that is engaged to the third ring gear 400 in the first segment 560 of the second cam slots 544*a* and 544*b* so that the third ring gear 400 is positioned in its first position (i.e., such that the teeth 400*a* of the third ring gear 400 are engaged only with the teeth 438*a* of the third planet gears 438). In this position, the third ring gear 400 is positioned proximate the clutch member 800 such that the fifth clutch teeth 812 (formed on a rearward side of the clutch member 800) meshingly engage the second clutch teeth 400*b* (formed on a frontward side of the inner annular member 420) and the sixth clutch teeth 814 (formed on a radially outward side of the clutch member 800) are meshingly engaged with the fourth clutch teeth 400*d* (formed on a frontward end of the outer annular structure 422) to thereby non-rotatably couple or "ground" the inner annular member 420 to the transmission sleeve 200 through the clutch assembly 18. Accordingly, when the rotary selector cam 520 is positioned in the first rotational position the reduction gear set assembly 202 will operate in a low speed setting and the clutch assembly 18 is configured to limit the maximum output torque transmitted through the reduction gear set assembly 202 by limiting the maximum reaction torque that is applied against the inner annular structure 420.

With reference to FIGS. 4 through 6, positioning the rotary selector cam 520 in the second rotational position positions the tabs 526 of the wire clip 522 that is engaged to the second ring gear 360 in the second segment 550 of the first cam slots 540*a* and 540*b* so that the second ring gear 360 is positioned in its second position (i.e., such that the second set of mating locking features 360*b* are disengaged from the second set of locking features 216 and the gear teeth 360*a* are disengaged from the gear teeth 314*a* on the first reduction carrier 314). Positioning the rotary selector cam 520 in the second rotational position also positions the tabs 526 of the wire clip 522 that is engaged to the third ring gear 400 in the second segment 560 of the second cam slots 544*a* and 544*b* so that the third ring gear 400 is positioned in its second position (i.e., such that the teeth 400*a* of the third ring gear 400 are engaged with both the teeth 438*a* of the third planet gears 438 and the teeth 364*a* of the second reduction carrier 364). Additionally, the third clutch teeth 400*c* (formed on the rearward side of the outer annular structure 422) can engage the first clutch teeth 360*c* (formed on a frontward side of the second ring gear 360) while the fifth clutch teeth 814 (formed on the clutch member 800) engage the fourth clutch teeth 400*d* (formed on the outer annular structure 422) such that the outer annular structure 422 will be non-rotatably coupled to the second ring gear 360. In this condition, the second ring gear 360 and the outer annular structure 422 are non-rotatably coupled or grounded to the transmission sleeve 200 through the clutch assembly 18. Accordingly, when the rotary selector cam 520 is positioned in the second rotational position, the reduction gear set assembly 202 will operate in an intermediate speed setting and the clutch assembly 18 is configured to limit the maximum output torque transmitted through the reduction gear set assembly 202 by limiting the maximum reaction torque that is applied against the second ring gear 360.

With reference to FIGS. 4, 5 and 7, positioning the rotary selector cam 520 in the third rotational position positions the tabs 526 of the wire clip 522 that is engaged to the second ring gear 360 in the third segment 550 of the first cam slots 540*a* and 540*b* so that the second ring gear 360 is positioned in its third position (i.e., such that the second set of mating locking features 360*b* are disengaged from the second set of locking features 216 and the gear teeth 360*a* are engaged to the gear teeth 314*a* on the first reduction carrier 314 as well as the teeth 344*a* on the second planet gears 344). Positioning the rotary selector cam 520 in the third rotational position also positions the tabs 526 of the wire clip 522 that is engaged to the third ring gear 400 in the third segment 560 of the second cam slots 544*a* and 544*b* so that the third ring gear 400 is positioned in its first position (i.e., such that the teeth 400*a* of the third ring gear 400 are engaged only with the teeth 438*a* of the third planet gears 438).

In this position, the third ring gear 400 is positioned proximate the clutch member 800 such that the fifth clutch teeth 812 (formed on a rearward side of the clutch member 800) meshingly engage the second clutch teeth 400*b* (formed on a frontward side of the inner annular member 420) and the sixth clutch teeth 814 (formed on a radially outward side of the clutch member 800) are meshingly engaged with the fourth clutch teeth 400*d* (formed on a frontward end of the outer annular structure 422) to thereby non-rotatably couple or "ground" the inner annular member 420 to the transmission sleeve 200 through the clutch assembly 18. Accordingly, when the rotary selector cam 520 is positioned in the third rotational position, the reduction gear set assembly 202 will operate in a high speed setting and the clutch assembly 18 is configured to limit the maximum output torque transmitted through the reduction gear set assembly 202 by limiting the maximum reaction torque that is applied against the inner annular structure 420.

Figure 8:
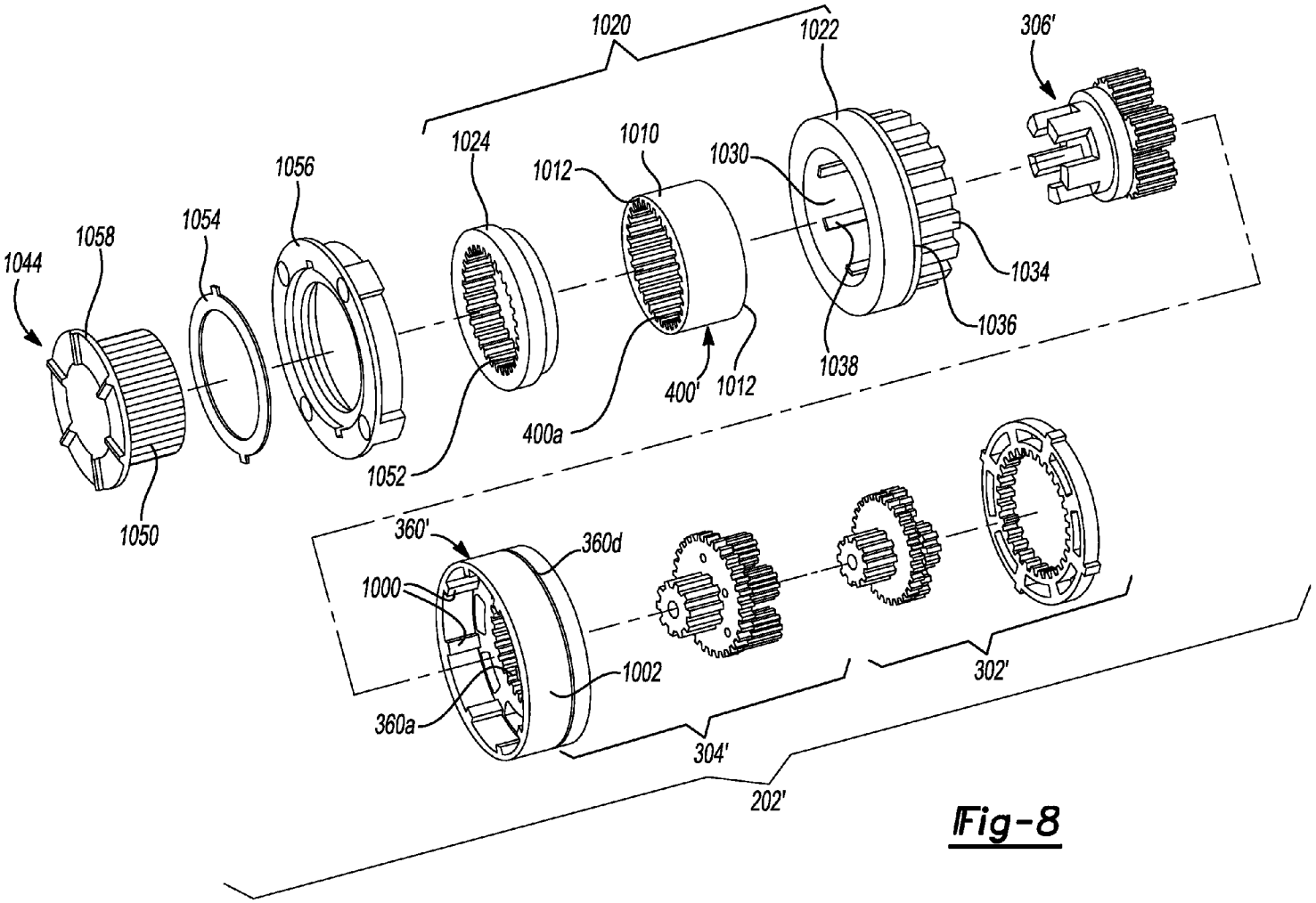
FIG. 8 is an exploded perspective view of a portion of an alternate multi-speed transmission assembly constructed in accordance with the teachings of the present disclosure.
Figure 9:
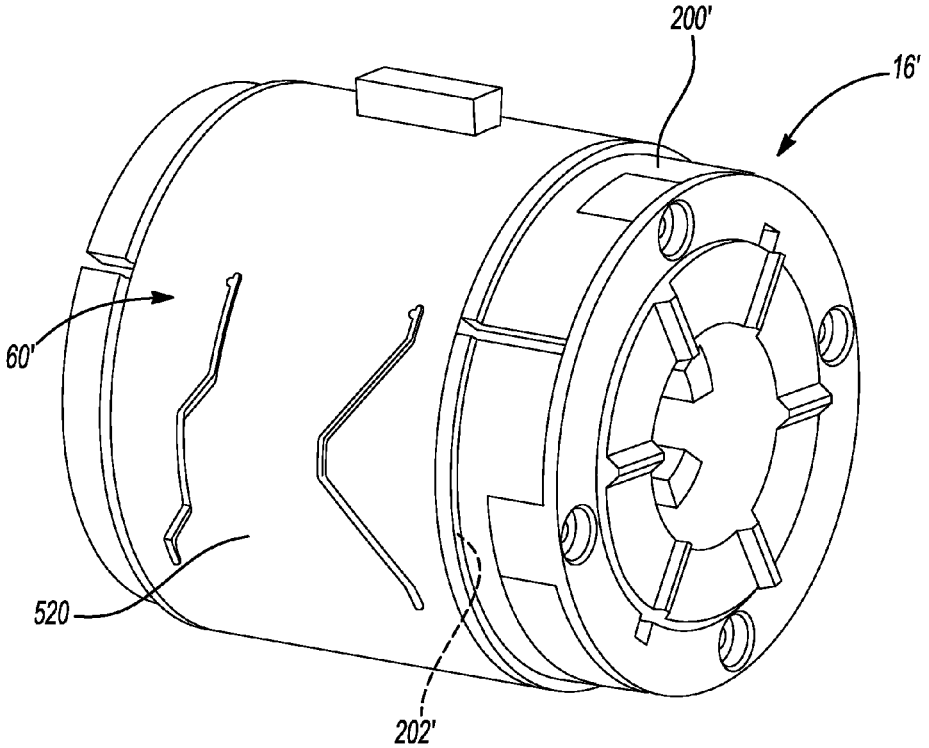
FIG. 9 is a perspective view of the multi-speed transmission assembly of FIG. 8.

With reference to FIGS. 8 and 9, an alternately constructed multi-speed transmission assembly is generally indicated by reference numeral 16'. The transmission assembly 16' can be a three-stage, three speed transmission that can include a transmission sleeve 200', a reduction gear set assembly 202' and a speed selector mechanism 60'. The transmission sleeve 200' can be generally similar to the transmission sleeve 200 (FIG. 2) described in detail, above, except that the wall member 210' can define only a first set of locking features 214'.

The reduction gear set assembly 202' can include a first stage or reduction gear set 302', a second stage or reduction gear set 304' and a third stage or reduction gear set 306'. The first reduction gear set 302' can be generally similar to the first reduction gear set 302 (FIG. 3) described in detail above.

The second reduction gear set 304' can be generally similar to the second reduction gear set 304 (FIG. 3) described in detail above, except for the second ring gear 360'. The second ring gear 360' can be an annular structure, having a plurality of gear teeth 360*a*, which can be formed about its interior circumferential surface, a plurality of internal locking features 1000, and a first actuator groove 360*d* that can be formed about the exterior circumference of the second ring gear 360'. The internal locking features 1000 can be formed about an interior circumferential surface of the second ring gear 360' that is spaced axially apart from the gear teeth 360*a*. The exterior surface 1002 can be cylindrically shaped so as to be rotatably and axially slidably received in the hollow cavity 212' (FIG. 10) of the transmission sleeve 200'.

The third reduction gear set 306' can be generally similar to the third reduction gear set 306' (FIG. 3) described in detail above, except for the third ring gear 400'. The third ring gear 400' can be an annular structure that can define a plurality of internal gear teeth 400*a*', a cylindrical outer surface 1010, and opposite axial ends 1012.

Figure 10:
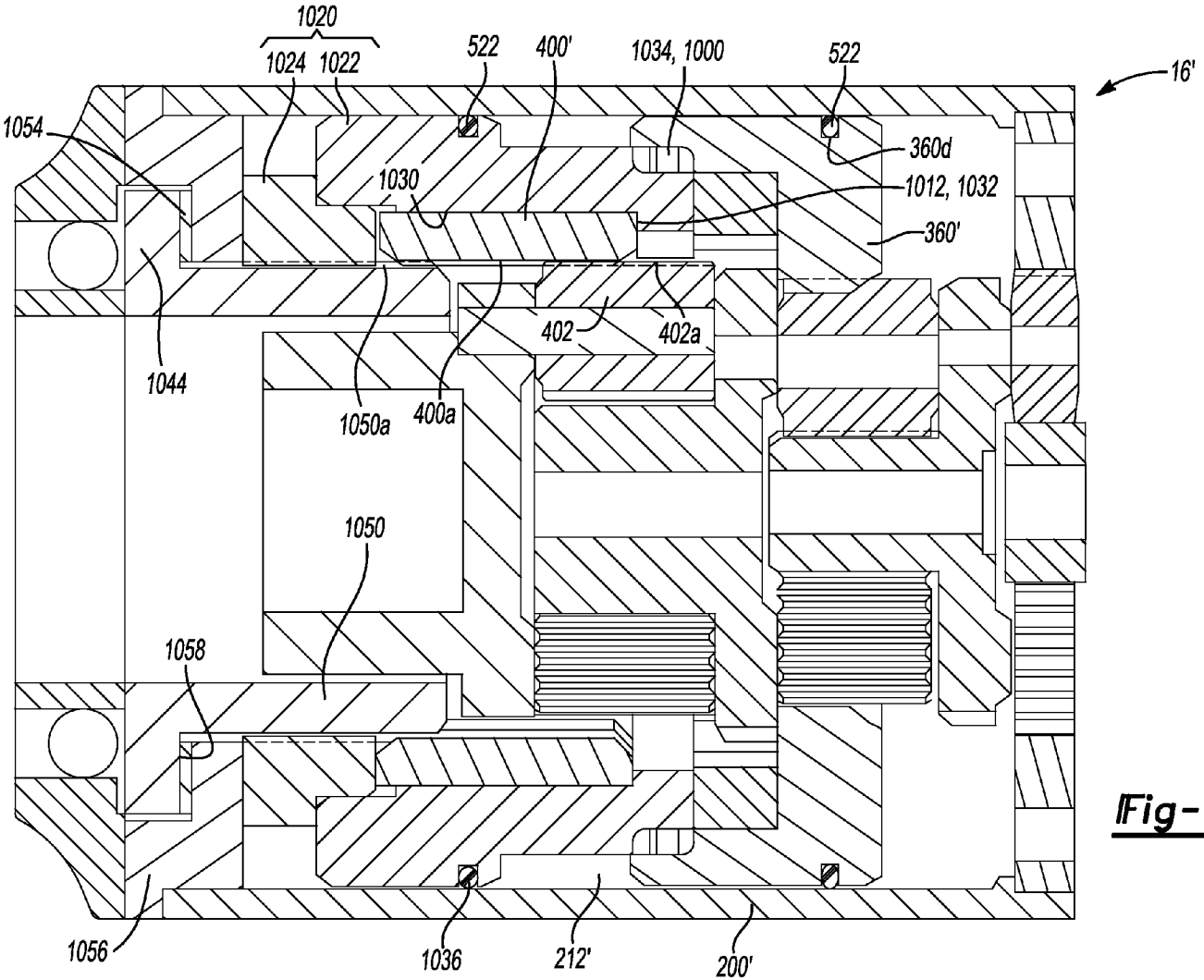
FIGS. 10, 11 and 12 are longitudinal section views of the multi-speed transmission assembly, showing the multi-speed transmission assembly in low, medium and high speed settings.

With reference to FIGS. 8 through 10, the speed selector mechanism 60' can be generally similar to the speed selector mechanism 60 (FIG. 3) described above, except that it can include a coupler 1020. The coupler 1020 can comprise a first coupler portion 1022 and a second coupler portion 1024. The first coupler portion 1022 can be an annular structure that can define a ring gear bore 1030, a shoulder wall 1032, a plurality of external locking features 1034, and a second actuator groove 1036 that can be formed about the exterior circumference of the first coupler portion 1022. The ring gear bore 1030 is sized to receive the third ring gear 400' in a manner that permits the third ring gear 400' to rotate relative to the first coupler portion 1022. If desired, a plurality of lubricant grooves 1038 can be formed into the first coupler portion 1022 and configured to hold a lubricant, such as a grease. The shoulder wall 1032 can be configured to abut a first one of the axial ends 1012 of the third ring gear 400'. The external locking features—can be configured to be received into the second ring gear 360' and engage the internal locking features 1000.

The second coupler portion 1024 can be fixedly coupled to the first coupler portion 1022 and can abut a second one of the axial ends 1012 of the third ring gear 400' on a side opposite the shoulder wall 1032. Accordingly it will be appreciated that the first and second coupler portions 1022 and 1024 cooperate to confine the third ring gear 400' in an axial direction (i.e., longitudinally) relative to the coupler 1020 but permit the third ring gear 400' to rotate freely relative to the coupler 1020.

The second coupler portion 1024 can include a coupling means that permits the coupler 1020 to be non-rotatably but axially slidably coupled to the housing of the power tool in which the transmission assembly 16' is installed. In this regard, the coupling means can physically couple or connect the second coupler portion 1024 to any structure that is non-rotatably coupled to the housing, such as the transmission sleeve 200'. In the particular example provided, however, the coupling means is configured to physically couple or connect the second coupling portion 1024 to a clutch element 1044 of a clutch assembly (not shown). The remainder of the clutch assembly can be generally conventional in its construction and can apply a spring-generated axial force (designated by an arrow in FIG. 12) onto one or more corresponding clutch elements (e.g., bearing balls as show in FIG. 12) such that contact between the clutch element 1044 and the corresponding clutch element(s) tends to resist rotation of the clutch element 1044 relative to the housing or a component fixed thereto (e.g., the transmission sleeve 200'). Accordingly, it will be appreciated that the clutch element 1044 is non-rotatable relative to the housing or a component fixed thereto (e.g., the transmission sleeve 200') unless the torque transmitted through the transmission assembly 16' causes the clutch element 1044 to cam or ride over the corresponding clutch element(s), in which case the clutch element 1044 rotates relative to the housing or a component fixed thereto (e.g., the transmission sleeve 200') to limit the magnitude of the torque that is transmitted through the transmission assembly 16'.

In the particular example provided, the clutch element 1044 is coupled to an externally-toothed hollow cylinder 1050 that is meshed with corresponding internal teeth 1052 formed in the second coupler portion 1024. A thrust washer 1054 can be received between an endcap 1056, which is non-rotatably coupled to an end of the transmission sleeve 200' and a rear surface 1058 of the clutch element 1044.

The wire clips 522 can be received into the first and second actuator grooves 360*d* and 1036 so that rotation of the rotary selector cam 520 can cause corresponding axial motion of the second ring gear 360' and the coupler 1020.

In FIG. 10, the transmission assembly 16' is shown to be configured in a first or low speed ratio in which the coupler 1022 is positioned so as to cause engagement of the external locking features 1034 of the first coupling portion 1022 with the internal locking features 1000 of the second ring gear 360', the internal teeth 400*a* of the third ring gear 400' are meshed to the teeth 402*a* of the third planet gears 402 as well as to the teeth 1050*a* of the externally-toothed hollow cylinder 1050 that is fixed to the clutch element 1044. Configuration in this manner torsionally couples or grounds the second ring gear 360' and the third ring gear 400' to the clutch element 1044, so that the second and third ring gears 360' and 400' do not rotate relative to the transmission sleeve 200' unless the magnitude of the torque that is transmitted through the transmission assembly 16' exceeds a predetermined clutch torque.

Figure 11:
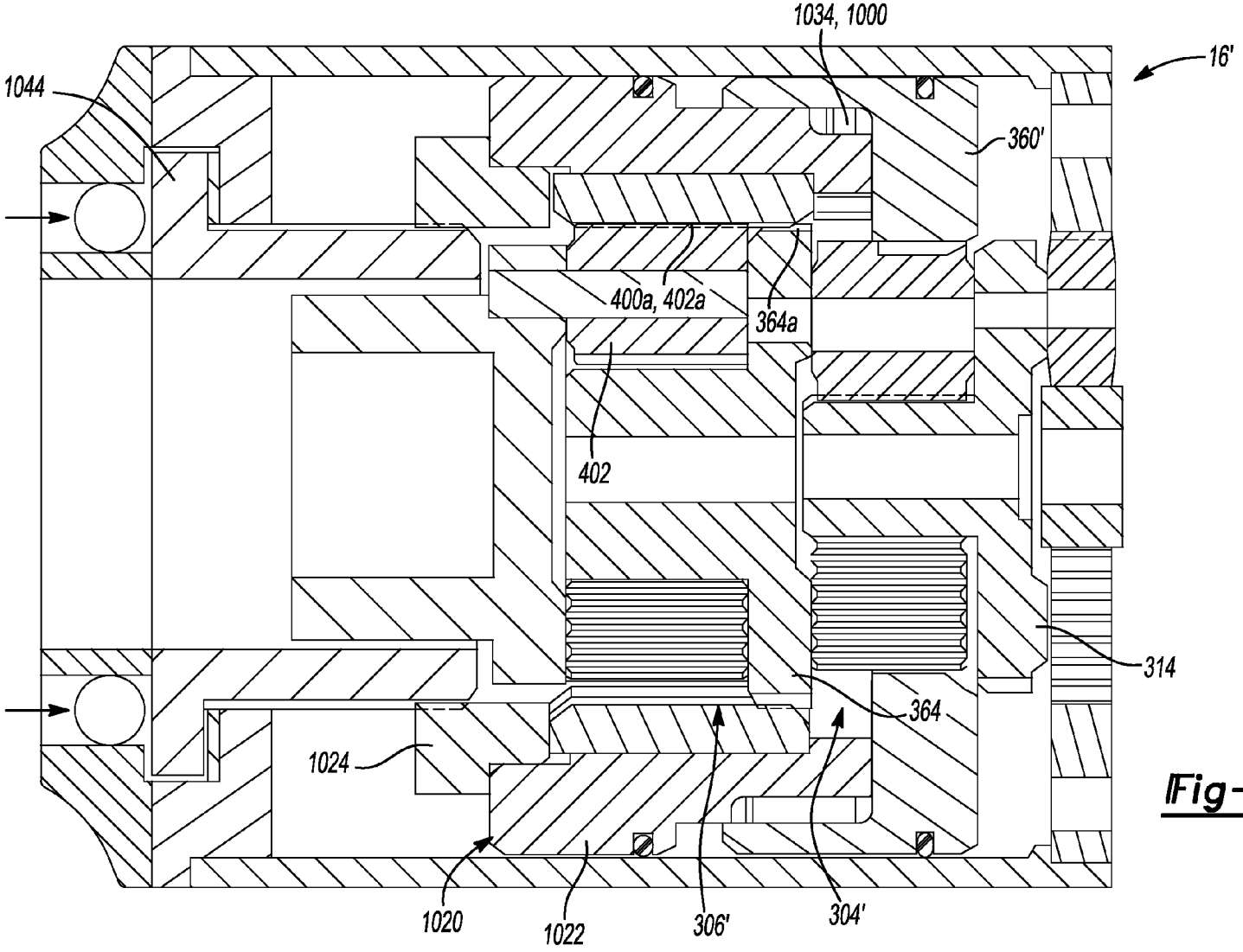

In FIG. 11, the transmission assembly 16' is shown to be configured in a second or medium speed ratio in which the coupler 1020 is positioned so as to cause engagement of the external locking features 1034 of the first coupling portion 1022 with the internal locking features 1000 of the second ring gear 360' and the internal teeth 400*a* of the third ring gear 400' are meshed to the teeth 402*a* of the third planet gears 402 as well as to the teeth 364*a* of the second reduction carrier 364. Configuration in this manner torsionally couples or grounds the second ring gear 360' to the clutch element 1044 so that the second ring gear 360' does not rotate relative to the transmission sleeve 200' unless the magnitude of the torque that is transmitted through the transmission assembly 16' exceeds a predetermined clutch torque. Configuration in this manner also locks the third reduction gear set 306' so that the third reduction gear set 306' operates at a 1:1 speed ratio (i.e., the output speed of the third reduction gear set 306' is equal to the output speed of the second reduction gear set 304').

Figure 12:
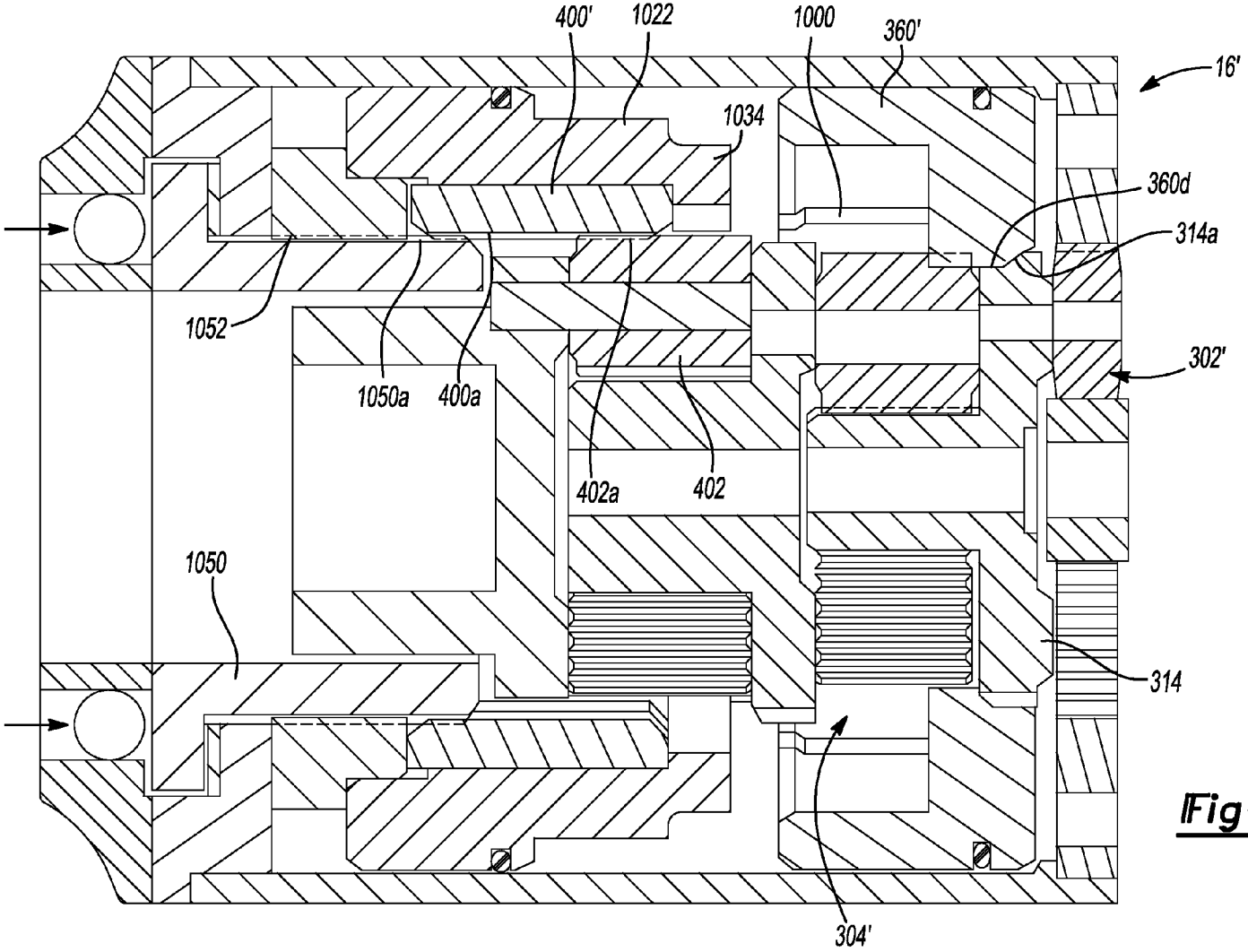

In FIG. 12, the transmission assembly 16' is shown to be configured in a third or high speed ratio in which the coupler 1020 is positioned so that the external locking features 1034 of the first coupling portion 1022 are disengaged from the internal locking features 1000 of the second ring gear 360' and the internal teeth 400*a* of the third ring gear 400' are meshed to the teeth 402*a* of the third planet gears 402 as well as to the teeth 1050*a* of the externally-toothed hollow cylinder 1050 that is fixed to the clutch element 1044. Additionally, the second ring gear 360' is positioned axially rearward such that the internal teeth 360*d* are meshingly engaged with the external teeth 314*a* formed on the first reduction carrier 314. Configuration in this manner torsionally couples or grounds the third ring gear 400' to the clutch element 1044 so that the third ring gear 400' does not rotate relative to the transmission sleeve 200' unless the magnitude of the torque that is transmitted through the transmission assembly 16' exceeds a predetermined clutch torque. Configuration in this manner also locks the second reduction gear set 304' so that the second reduction gear set 304' operates at a 1:1 speed ratio (i.e., the output speed of the second reduction gear set 304' is equal to the output speed of the first reduction gear set 302').

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A power tool comprising:

a housing that defines a handle;

a motor coupled to the housing;

a trigger coupled to the housing and configured to control operation of the motor;

a multi-speed transmission configured to transmit rotary power between the motor and the output spindle, the multi-speed transmission comprising a plurality of planetary stages including a first stage, a second stage and a third stage, the second stage receives rotary power from the first stage, the first stage having a first internally toothed gear element, the second stage having a second internally toothed gear element and the third stage having a third internally toothed gear element; and a torque clutch that limits torque output from the multi-speed transmission to the output spindle, the torque clutch being configured to alternatively ground the second and third internally toothed gear elements to the housing through the torque clutch based on a speed ratio setting of the multi-speed transmission.

2. The power tool of claim 1, wherein the torque clutch comprises a clutch member having a first set of clutch teeth and a second set of clutch teeth, the first set of clutch teeth being configured to couple to a corresponding set of teeth formed on the second internally toothed gear element to ground the second internally toothed gear element to the housing, the second set of clutch teeth being configured to couple a corresponding set of teeth formed on the third internally toothed gear element to ground the third internally toothed gear element to the housing.

3. The power tool of claim 2, wherein the second stage of the multi-stage transmission comprises an outer annular structure, and wherein the second internally toothed gear element is mounted to the outer annular structure for rotation therein.

4. The power tool of claim 3, wherein the outer annular structure comprises a first set of intermediate clutch teeth and a second set of intermediate clutch teeth, and wherein when the second internally toothed gear element is grounded to the housing, the first set of clutch teeth are meshed to the first set of intermediate clutch teeth and the corresponding set of teeth formed on the second internally toothed gear element are meshed with the second set of intermediate clutch teeth.

5. A power tool comprising:

a housing that defines a handle;

a motor coupled to the housing;

a trigger coupled to the housing and configured to control operation of the motor;

a multi-speed transmission having a planetary stage with a ring gear and a plurality of planet gears, the ring gear having an annular inner structure and an annular outer structure, the annular inner structure having a plurality of teeth that are in meshing engagement with the plurality of planet gears, the annular outer structure being axially fixed to but rotatably mounted on the annular inner structure, wherein the ring gear is axially movable between a first position and a second position when the multi-speed transmission is shifted between a first speed ratio and a second speed ratio.

6. The power tool of claim 5, further comprising a torque clutch having a clutch member, wherein the annular outer structure is coupled to the clutch member for rotation therewith when the ring gear is disposed in the second position.

7. The power tool of claim 6, wherein the annular outer structure is rotatable relative to the clutch member when the ring gear is disposed in the first position.

8. The power tool of claim 5, wherein the multi-speed transmission has a second ring gear, wherein the annular outer structure has a plurality of second teeth that meshingly engage with teeth formed on an element of the second ring gear.

9. The power tool of claim 8, wherein the second ring gear is axially movable between first and second positions, wherein placement of the second ring gear in its first position non-rotatably couples the second ring gear to the housing, and wherein placement of the second ring gear in its second position permits the second ring gear to rotate relative to the housing.

10. A power tool comprising:

a housing;

a motor coupled to the housing;

a trigger that is coupled to the housing and configured to control operation of the motor;

an output spindle; and a multi-speed transmission configured to transmit rotary power between the motor and the output spindle, the multi-speed transmission having a plurality of planetary stages, a first one of the planetary stages having a planet carrier, a second one of the planetary stages having a plurality of planet gears and a ring gear that is meshingly engaged with the planet gears, the ring gear of the second one of the planetary stages being movable along a longitudinal axis of the multi-speed transmission between a first position, a second position, and a third position;

wherein the ring gear of the second one of the planetary stages is non-rotatably engaged to the housing when the ring gear of the second one of the planetary stages is in the first position;

wherein the ring gear of the second one of the planetary stages is disengaged from the housing and non-rotatably engaged to the planet carrier when the ring gear of the second one of the planetary stages is in the third position; and wherein the ring gear of the second one of the planetary stages is disengaged from the housing and the planet carrier and engaged to an outer annular structure of a ring gear of another of the planetary stages when the ring gear of the second one of the planetary stages is in the second position.

11. The power tool of claim 10, wherein the ring gear of the another of the planetary stages comprises an annular inner portion and an annular outer portion that is rotatably mounted on the annular inner portion.

12. The power tool of claim 11, wherein the ring gear of the second one of the planetary stages is non-rotatably coupled to the annular outer portion when the ring gear of the second one of the planetary stages is in the second position.

13. A power tool comprising a housing, a motor, a trigger, a multi-speed transmission and a torque clutch, the housing defining a handle, the motor being coupled to the housing, the trigger being coupled to the housing and configured to control operation of the motor, the multi-speed transmission having first and second ring gears, the torque clutch comprising a clutch member, a follower, and a clutch spring, the clutch member having first and second sets of clutch teeth and a clutch profile, the first set of clutch teeth being configured to non-rotatably couple the second ring gear to the clutch member, the second set of clutch teeth being configured for use in non-rotatably coupling the first ring gear to the clutch member, the follower being non-rotatably coupled to the housing, the clutch spring biasing the follower into engagement with the clutch profile to resist rotation of the clutch member.

14. A power tool comprising:

a housing that defines a handle;

a motor coupled to the housing;

a trigger coupled to the housing and configured to control operation of the motor;

a multi-speed transmission configured to transmit rotary power between the motor and the output spindle, the multi-speed transmission comprising a plurality of planetary stages arranged about a rotational axis, the plurality of planetary stages including a first stage and a second stage that receives rotary power from the first stage, the first stage having a first internally toothed gear element, the second stage having a second internally toothed gear element; and a speed selector having a coupler, the coupler being non-rotatably but slidably coupled to the housing for movement along the rotational axis between a first position, a second position and a third position, the second internally toothed gear element being axially fixed but rotatable relative to the coupler, wherein positioning the coupler in the first position non-rotatably couples the first and second internally toothed gear elements to the housing, wherein positioning the coupler in the second position non-rotatably couples the first internally toothed gear element to the housing and positions the second internally toothed gear element such that it is rotatable relative to the housing, and wherein positioning the coupler in the third position decouples the coupler from the first internally toothed gear element and positions the second internally toothed gear element such that it is non-rotatably coupled to the housing.

15. The power tool of claim 14, wherein the coupler is non-rotatably coupled to a clutch element, wherein the clutch element is maintained in a non-rotating condition relative to the housing when a magnitude of torque transmitted through the multi-speed transmission is less than a predetermined clutch torque, and wherein the clutch element and the coupler rotate relative to the housing when the magnitude of torque transmitted through the multi-speed transmission is greater than or equal to the predetermined clutch torque.

* * * * *